US007381129B2

(12) United States Patent
Avedon

(10) Patent No.: US 7,381,129 B2
(45) Date of Patent: Jun. 3, 2008

(54) COLUMNAR AIR MOVING DEVICES, SYSTEMS AND METHODS

(75) Inventor: Raymond B. Avedon, Boulder, CO (US)

(73) Assignee: Airius, LLC., Longmont, CO (US)

( * ) Notice: Subject to any disclaimer, the term of this patent is extended or adjusted under 35 U.S.C. 154(b) by 145 days.

(21) Appl. No.: 11/027,039

(22) Filed: Dec. 30, 2004

(65) Prior Publication Data

US 2005/0202776 A1 Sep. 15, 2005

Related U.S. Application Data

(60) Provisional application No. 60/553,720, filed on Mar. 15, 2004.

(51) Int. Cl.
*F24F 7/06* (2006.01)

(52) U.S. Cl. ..... 454/230; 416/247 R

(58) Field of Classification Search ..... 454/230, 454/231, 233, 310; 415/206, 196
See application file for complete search history.

(56) References Cited

U.S. PATENT DOCUMENTS

| | | | | |
|---|---|---|---|---|
| 3,827,342 | A | 8/1974 | Hughes | |
| 3,932,054 | A * | 1/1976 | McKelvey | 415/130 |
| 3,973,479 | A | 8/1976 | Whiteley | |
| 4,152,973 | A | 5/1979 | Peterson | |
| 4,185,545 | A | 1/1980 | Rusth et al. | |
| 4,344,112 | A | 8/1982 | Brown | |
| 4,396,352 | A * | 8/1983 | Pearce | 416/206 |
| 4,473,000 | A * | 9/1984 | Perkins | 454/299 |
| 4,512,242 | A | 4/1985 | Bohanon, Sr. | |
| 4,522,255 | A | 6/1985 | Baker | |
| 4,550,649 | A | 11/1985 | Zambolin | |
| 4,662,912 | A | 5/1987 | Perkins | |
| 4,730,551 | A | 3/1988 | Peludat | |
| 5,033,711 | A * | 7/1991 | Gregorich et al. | 248/664 |
| 5,042,366 | A | 8/1991 | Panetski et al. | |
| 5,078,574 | A | 1/1992 | Olsen | |
| 5,358,443 | A * | 10/1994 | Mitchell et al. | 454/230 |
| 5,429,481 | A * | 7/1995 | Liu | 416/246 |
| 5,513,953 | A | 5/1996 | Hansen | |
| 5,613,833 | A * | 3/1997 | Wolfe et al. | 416/246 |
| 6,004,097 | A * | 12/1999 | Wark et al. | 415/206 |
| 6,109,874 | A * | 8/2000 | Steiner et al. | 416/63 |
| 6,145,798 | A * | 11/2000 | Janisse et al. | 248/324 |
| 6,149,513 | A | 11/2000 | Lyu | |
| 6,168,517 | B1 | 1/2001 | Cook | |
| 6,361,431 | B1 | 3/2002 | Kawano | |
| 6,458,028 | B2 | 10/2002 | Snyder | |

(Continued)

*Primary Examiner*—Derek S Boles
(74) *Attorney, Agent, or Firm*—Knobbe, Martens, Olson & Bear, LLP.

(57) ABSTRACT

Air moving device includes a housing, an impeller in the housing for generating a downward air flow, and vanes in the housing in close proximity to and a selected distance below the impeller to straighten the air flow. The device produces an air flow that substantially remains in a column over a substantial distance. The method includes producing an air flow that substantially remains in a column over a substantial distance and directing the air flow from the ceiling towards the floor to provide temperature destratification of the air in an enclosed space. The method also includes directing warm air from the ceiling to the floor and storing heat in the floor, apparatus on the floor and ground under the floor. The stored heat is released when the ceiling is cooler than the floor.

22 Claims, 10 Drawing Sheets

U.S. PATENT DOCUMENTS 6,575,011 B1 * 6/2003 Busby et al. ..... 73/7
6,581,974 B1 * 6/2003 Ragner et al. ..... 285/7
6,592,328 B1 * 7/2003 Cahill ..... 416/155
6,679,433 B2 * 1/2004 Gordon et al. ..... 237/12.1

* cited by examiner

COLUMNAR AIR MOVING DEVICES, SYSTEMS AND METHODS

This application claims the benefit under 35 U.S.C. § 119(e) of the U.S. provisional patent application No. 60/553,720 filed Mar. 15, 2004.

TECHNICAL FIELD

The present invention relates to heating, ventilating and air conditioning air spaces, and more particularly to systems, devices and methods for moving air in a columnar pattern with minimal lateral dispersion that are particularly suitable for penetrating air spaces and air temperature de-stratification.

BACKGROUND ART

The rise of warmer air and the sinking of colder air creates significant variation in air temperatures between the ceiling and floor of buildings with conventional heating, ventilation and air conditioning systems. Such air temperature stratification is particularly problematic in large spaces with high ceilings such as warehouses, gymnasiums, offices, auditoriums, hangers, commercial buildings, and even residences with cathedral ceilings, and can significantly decrease heating and air conditioning costs. Further, both low and high ceiling rooms can have stagnant or dead air. For standard ceiling heights with duct outlets in the ceiling there is a sharp rise in ceiling temperatures when the heat comes on.

One proposed solution to air temperature stratification is a ceiling fan. Ceiling fans are relatively large rotary fans, with a plurality of blades, mounted near the ceiling. The blades of a ceiling fan have a flat or airfoil shape. The blades have a lift component that pushes air upwards or downwards, depending on the direction of rotation, and a drag component that pushes the air tangentially. The drag component causes tangential or centrifugal flow so that the air being pushed diverges or spreads out. Conventional ceiling fans are generally ineffective as an air de-stratification device in relatively high ceiling rooms because the air pushed by conventional ceiling fans is not maintained in a columnar pattern from the ceiling to the floor, and often disperses or diffuses well above the floor.

Another proposed solution to air temperature stratification is a fan connected to a vertical tube that extends substantially from the ceiling to the floor. The fan may be mounted near the ceiling, near the floor or in between. This type of device may push cooler air up from the floor to the ceiling or warmer air down from the ceiling to the floor. Such devices, when located away from the walls in an open space in a building, interfere with floorspace use and are not aesthetically pleasing. When confined to locations only along the walls of an open space, such devices may not effectively circulate air near the center of the open space. Examples of fans connected to vertical tubes are disclosed in U.S. Pat. No. 3,827,342 to Hughes, and U.S. Pat. No. 3,973,479 to Whiteley.

A device that provides a column of air that has little or no diffusion from the ceiling the floor, without a vertical tube, can effectively provide air de-stratification. U.S. Pat. Nos. 4,473,000 and 4,662,912 to Perkins disclose a device having a housing, with a rotating impeller having blades in the top of the housing and a plurality of interspersed small and large, vertically extending, radial stationary vanes spaced below the impeller in the housing. The device disclosed by Perkins is intended to direct the air in a more clearly defined pattern and reduce dispersion. Perkins, however, does not disclose the importance of a specific, relatively small gap between the impeller blades and the stationary vanes, and the device illustrated creates a vortex and turbulence due to a large gap and centrifugal air flow bouncing off the inner walls of the housing between the blades and vanes. Perkins also discloses a tapering vane section. The tapering vane section increases velocity of the exiting air stream.

A device with a rotary fan that minimizes the rotary component of the air flow while maximizing the axial air flow quantity and velocity can provide a column of air that flows from a high ceiling to a floor in a columnar pattern with minimal lateral dispersion that does not require a physical transporting tube. Such a device should reduce the energy loss by minimizing the rotary component of the air flow, and therefore minimizes turbulence. Such a device should minimize back pressure, since a pressure drop at the outlet of the device will cause expansion, velocity loss and lateral dispersion. The device should have minimum noise and low electric power requirements.

DISCLOSURE OF THE INVENTION

An air moving device which has a housing with an air inlet and an air outlet spaced from the inlet. A rotary impeller with a plurality of blades is mounted in the housing at the air inlet end and produces air flow with an axial component and a rotary component. A plurality of spaced, longitudinally extending, radial air guide vanes in the housing downstream of the impeller are in close proximity to the impeller blades to minimize the rotary component and change the air flow to a laminar and axial flow in the housing that exits the outlet end in a columnar pattern with minimal lateral dispersion. A method of moving air includes producing an air flow through a housing, and directing the air flow through the housing in a laminar and axial flow and exits an outlet so as to produce a columnar pattern with minimal lateral dispersion. The method also includes directing warm air from near the ceiling toward the floor, allowing the heat from the warm air to be stored in the floor, articles on the floor and the earth under the floor. The method includes directing air in a generally horizontal direction to allow penetration of an air space in a container, trailer truck or a room to promote flushing of that air space and circulation thereof. The device and method are particularly suitable for high efficiency, low power usage, air temperature de-stratification, and to improve air quality and circulation.

BRIEF DESCRIPTION OF THE DRAWINGS

Details of this invention are described in connection with the accompanying drawings that bear similar reference numerals in which.

DETAILED DESCRIPTION OF THE INVENTION

Figure 1:
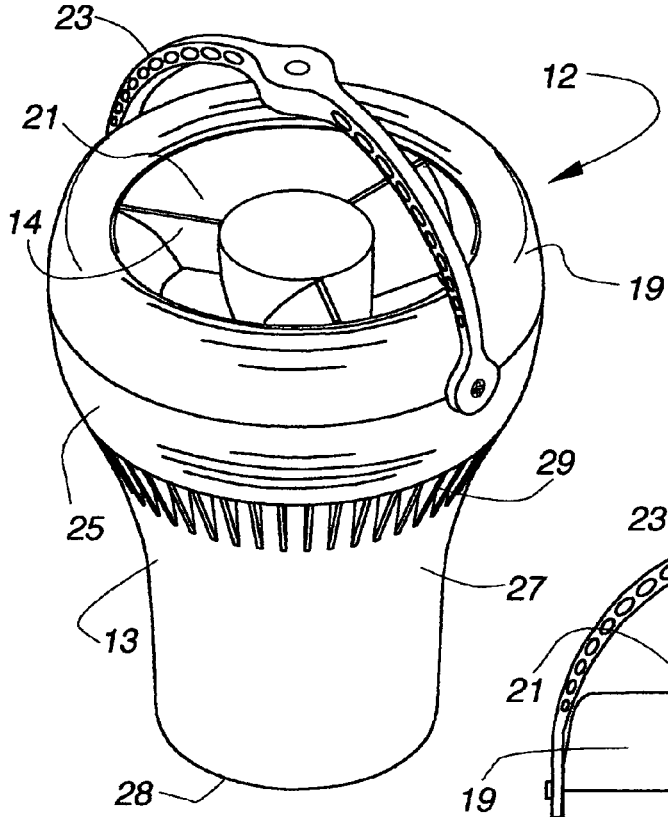
FIG. 1 is a top perspective view of an air moving device embodying features of the present invention.
Figure 2:
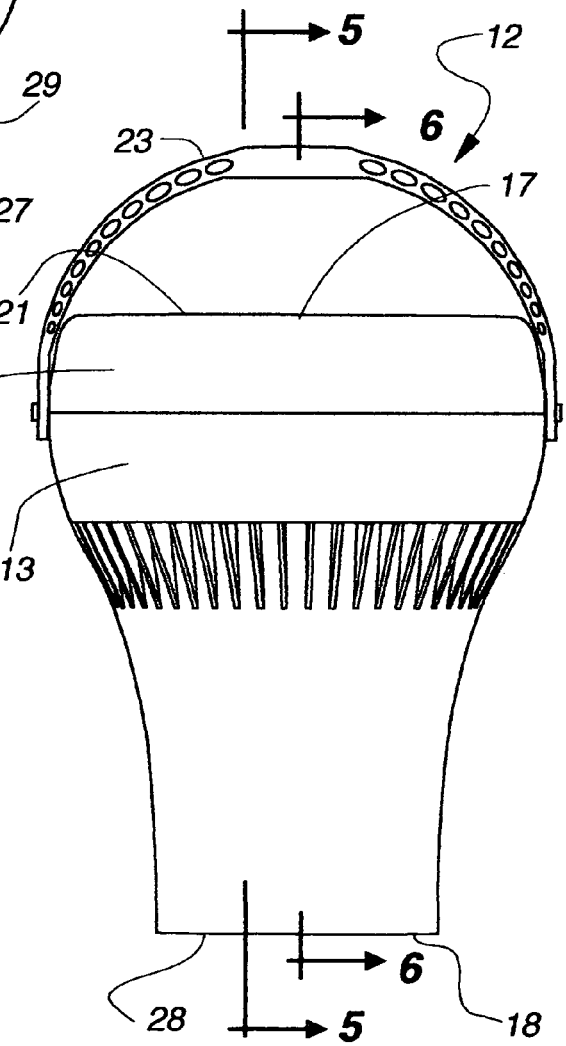
FIG. 2 is a side elevation view of the device of FIG. 1.
Figure 3:
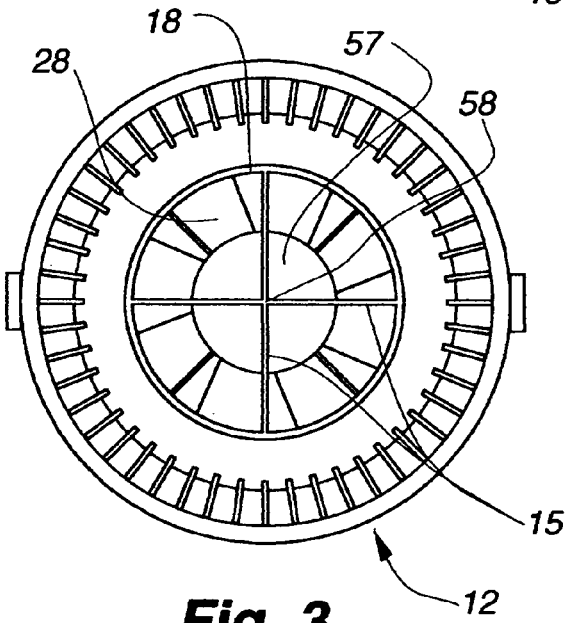
FIG. 3 is a bottom view of the device of FIG. 1.
Figure 4:
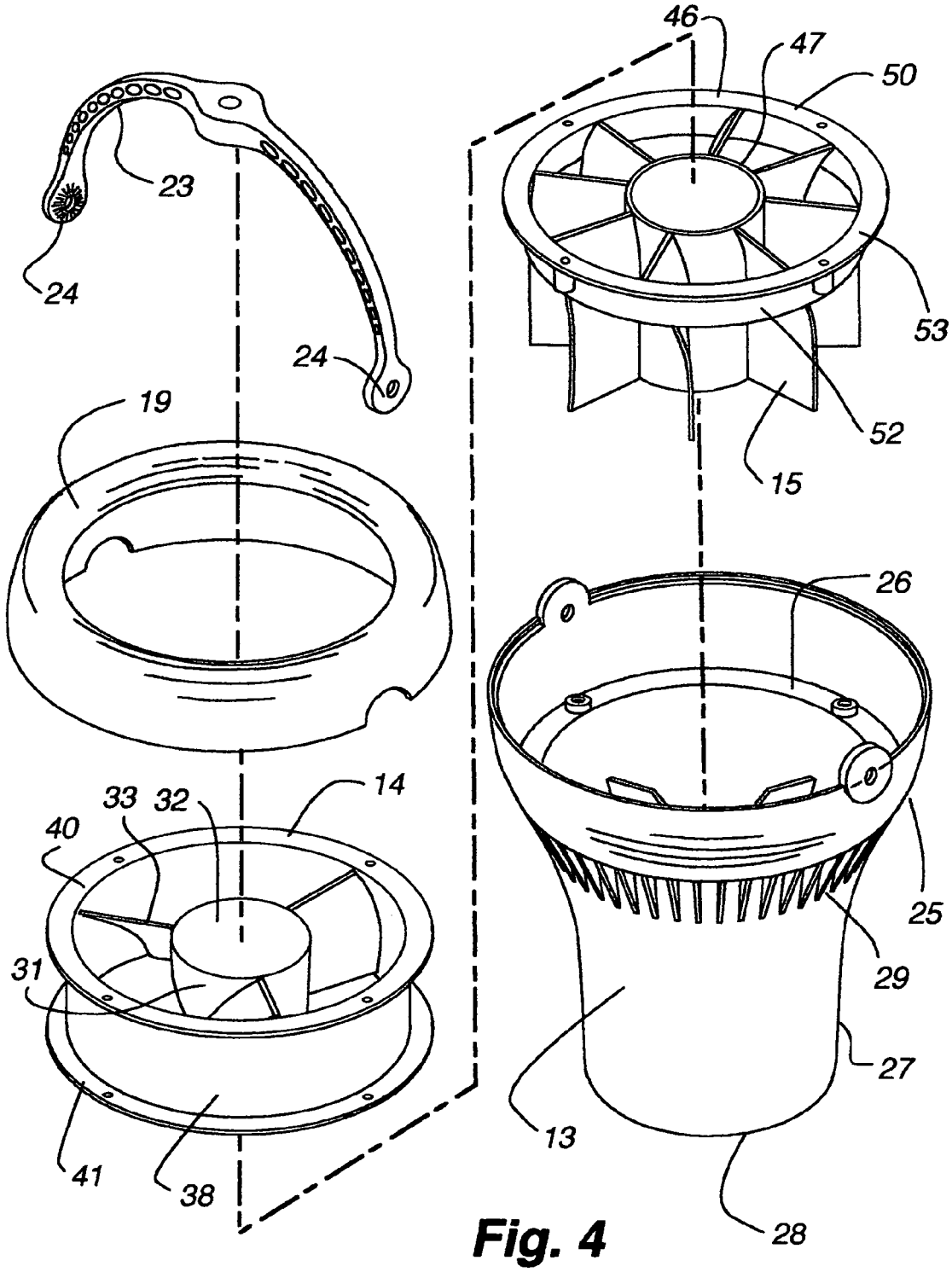
FIG. 4 is an exploded perspective view of the device of FIG. 1.
Figure 5:
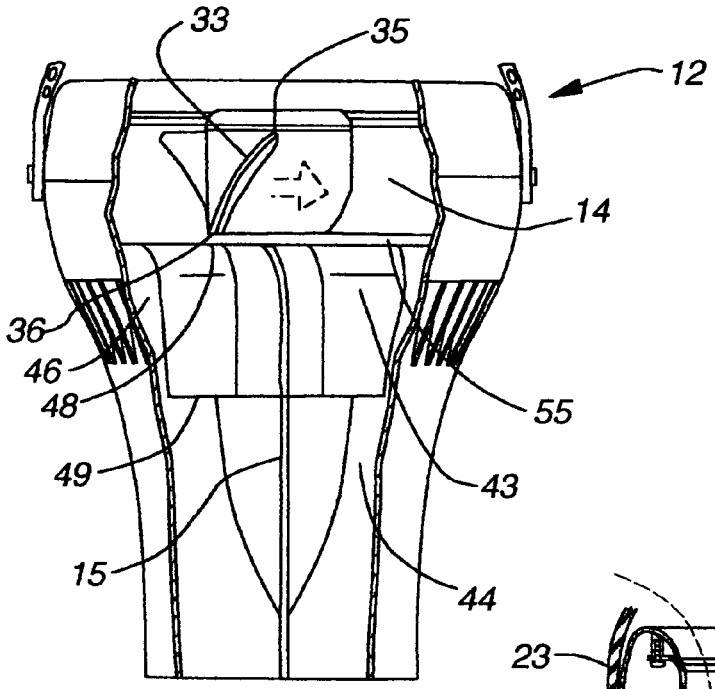
FIG. 5 is a sectional view taken along line 5-5 of FIG. 2.
Figure 6:
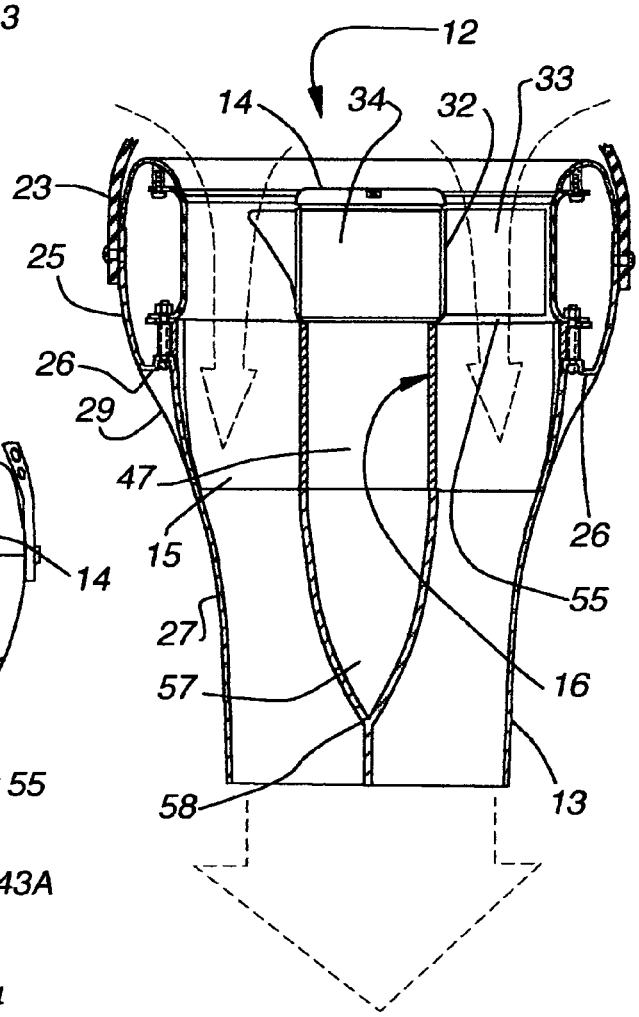
FIG. 6 is a sectional view taken along line 6-6 of FIG. 2.

Referring now to FIGS. 1 to 9, there is shown an air moving device 12 having an elongated outer housing 13, an electric rotary fan 14 in the housing for producing air flow in the housing and a plurality of longitudinally extending, outer radial vanes 15 and an inner housing hub 16 opposite the vanes in the housing downstream of the fan for directing air flow in the housing.

The housing 13 has a circular cross section, and an open first end 17 and an open second end 18 spaced from the first end 17. In the illustrated embodiment, a detachable, axially outwardly convex cowling 19 forms the first end 17 and provides an air inlet 21 with a diameter slightly smaller than the outer diameter of the cowling 19.

The housing 13 has a first section 25 extending from the cowling 19 to an interior shelf 26. A generally C-shaped hanger 23 mounts at opposite ends 24 to opposite sides of the housing 13 at the upper end of the first section 25, for mounting the air moving device 12 to a support. The first section 25, when viewed from the side, has a curved, slightly radially outwardly convex shape that conforms to the curvature of the cowling 19. The shelf 26 extends radially inwardly to join with the upstream end of a second section 27. The second section 27 tapers inwardly and extends axially from the shelf 26 to the second end 18 along a smooth curve that goes from radially outwardly convex near the shelf 26 to radially outwardly concave near the second end 18. The second end 18 forms an air outlet 28 that has a smaller diameter than the air inlet 21. A plurality of circumferentially spaced external fins 29 extend from the shelf 26 to the second section 27 to provide the appearance of a smooth curve from the air inlet 21 to the air outlet 28 when the housing 13 is viewed from the side.

The fan 14 includes an impeller 31 having a cylindrical, inner impeller hub 32, with an electric motor 34 therein, and a plurality of rigidly mounted, circumferentially spaced blades 33 extending radially from the impeller hub 32. In the illustrated embodiment the impeller 31 has three equally spaced blades 33 and rotates about an axis in a counterclockwise direction when viewed from above. Each blade 33, in side view, extends from an upstream edge 35, downwardly and leftwardly to a downstream edge 36 with each blade 33 being slightly concave, in an airfoil or wing shape, downwardly to propel air rightwardly as shown by the arrow. Each blade 33 then inclines at a selected angle to the axis of rotation of the impeller. Each blade 33 shown extends axially and radially toward the outlet or second end 18 to direct air axially with a rotary component. If the motor 34 runs in the opposite direction, the incline of the blades 33 would be reversed. The fan 14 includes a stationary cylindrical mounting ring 38 that extends around the blades 33, with the impeller hub 32 being rotably mounted relative to the mounting ring 38. The mounting ring 38 has spaced, protruding upstream and downstream rims 40 and 41. The fan 14 mounts in the housing 13 between the cowling 19 and the shelf 26.

Each of the vanes 15 is identical and includes upstream portion 43 and a downstream portion 44. The upstream portion 43 is carried in a stator 46. The stator 46 has a cylindrical stator hub 47 with a diameter substantially equal to the diameter of the impeller hub 32. The upstream portions 43 of the vanes 15 are mounted in a circumferentially spaced arrangement around the stator hub 47, and extend longitudinally along and radially from the stator hub 47. Each upstream portion 43 has an upstream end 48 and a downstream end 49. A support body 50 includes a cylindrical stator ring 52 that extends around the upstream portions 43 and connects to the outer ends of the upstream portions 43 of the vanes 15 near the upstream ends 48. The support body 50 also includes a protruding stator rim 53 that is substantially planar with the upstream ends 48 of the upstream portions 43 of the vanes 15, and that connects to the stator ring 52 and extends radially outwardly therefrom.

The housing 13 has an inner surface and the inner housing hub 16 has an outer surface concentric with a spaced from the housing inner surface to define an air flow passage through the housing. The inner housing hub 16 includes the fan hub 32, stator hub portion 47 and downstream hub portion 57, each having an outer surface and arranged end to end along the center of the housing and opposite and spaced from the housing inner surface to define the air flow passage. In particular, these outer surfaces shown are cylindrical and substantially the same diameter for a substantial portion of the passage and as the housing 13 converges the downstream hub portion 57 converges to generally follow the curvature of the inside surface of the housing.

The stator 46 nests in and is separable from the housing 13 with the stator rim 53 between the shelf 26 of the housing 13 and the downstream rim 41 of the mounting ring 38 of the fan 14, and with a gap 55 having a selected size between the downstream edge 36 of the blades 33 of the impeller 31 and the upstream ends 49 of the upstream portions 43 of the vanes 15. If the gap 55 is too large, turbulence will be generated in the air flow between the impeller 31 and the vanes 15, reducing the velocity of the air flow. If the gap 55 is too small, fluid shear stress will generate noise. The size of the gap 55 is generally selected as no greater than a maximum selected dimension to avoid turbulence and no less than a selected minimum dimension to avoid noise, and more particularly selected as small as possible without generating noise.

The selected size of the gap 55 is generally proportional to the diameter of the impeller 31 and may further be affected by the speed of the impeller 31. The following are examples: For an impeller 31 with a diameter of 6.00", at 1800 rpm, the maximum size of the gap 55 should be 1.25" and the minimum gap should be 0.2". For an impeller 31 with a diameter of 8.5", at 1400 rpm, the maximum size of the gap 55 should be 1.25", and the minimum gap should be 0.2" but could be 0.020 for lower rpm's as the size of the gap is rpm dependent. Generally, the maximum size of the gap 55 should be less than one half the diameter of the impeller 31.

In the illustrated embodiment, eight equally spaced upstream portions 43 of the vanes 15 are provided, and when viewed from the side, the upstream portions 43 of the vanes 15 extend straight upwardly from the downstream ends 49 and then curve leftwardly near the upstream ends 48. The upstream portion 43 of each curved vane portion is inclined at an angle opposite the incline of the blade 33 that extends axially and radially inward toward the outlet or second end 28 to assist in converting the rotary component of the air flow into laminar and axial flow in the housing.

Figure 7:
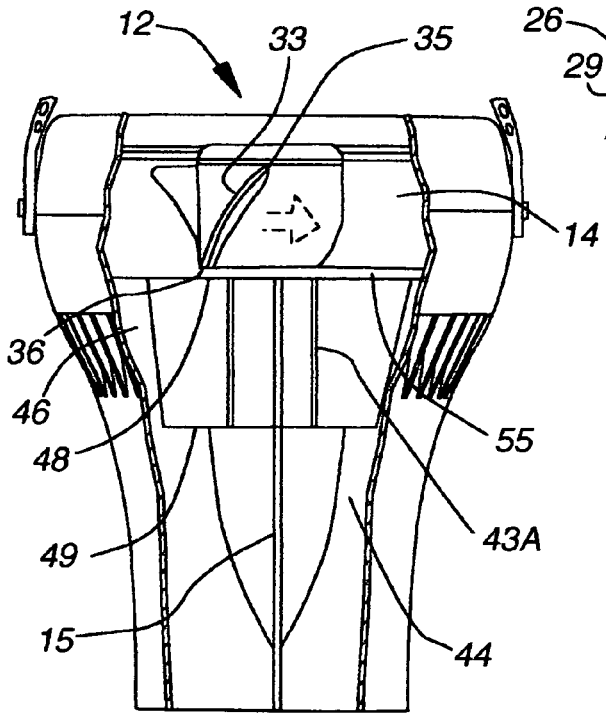
FIG. 7 is a sectional view taken along line 5-5 of FIG. 2, with straight upstream portions of the vanes.

Straight upstream portions 43A of the vanes 15 may also be used, as shown in FIG. 7, and other numbers of vanes 15 may be used. Further, if the motor 34 runs in the opposite direction, the incline of the curvature near the upstream ends 48 would be reversed.

The downstream portions 44 of the vanes 15 attach at an inner end to a downstream inner housing hub portion 57, are circumferentially spaced and extend radially outwardly from the housing hub portion 57 to the housing 13. The housing hub portion 57 and the downstream portions 44 of the vanes 15 extend axially from the stator 46 to or near the air outlet 28. The housing hub portion 57 has a circular cross section, has a diameter substantially equal to the diameter of the stator housing hub portion 47 at the upstream end adjacent to the stator housing hub portion 47, and tapers downstream to a point 58 near the air outlet 28. This hub portion may be characterized as torpedo shaped. In the illustrated embodiment there are four downstream portions 44 of the vanes 15 circumferentially spaced at 90 degrees, with each downstream portion 44 being aligned with an upstream portion 43 of a vane 15. Other numbers of downstream portions 44 of the vanes 15 can be used.

The number of the blades 33 may be 2, 3, 4, 5, 6, 7 or 8. The number of the vanes 15 may be 2, 3, 4, 5, 6, 7 or 8. The number of vanes 15 should be different from the number of blades 33. If the number of vanes 15 and blades 33 are the same, added noise is generated due to harmonics.

The air moving device 12 discharges air at a high velocity in a generally axial flow having a columnar pattern with minimal lateral dispersion after exiting the air outlet 28. The cowling 19 extends along a curve toward the inside to reduce turbulence and noise for air flow entering the air inlet 21. The impeller hub 32, the stator hub 47 and the housing hub 57 form the inner housing hub 16. The taper of the housing hub 57 generally follows the taper of the housing 13 so that the cross sectional area for air flow decreases about 10% to 35% through the air moving device 12 to avoid back pressure and at the same time increase air flow velocity. In the embodiment shown the air flow decreases about 22%.

The vanes 15 convert the rotary component of the air flow from the impeller 31 into laminar and axial air flow in the housing. The leftward curve of the upstream ends 48 of the upstream portions 43 of the vanes 15, in the illustrated embodiment, reduces the energy loss in the conversion of the rotary component of the air flow from the impeller 31 into laminar and axial air flow in the housing. The small gap 55 between the impeller 31 and vanes 15 prevents the generation of turbulence in the air flow in the gap 55. The taper of the housing 13 in combination with the taper of the housing hub 57 to the point 58 allows the air flow to exit the air outlet 28 in a continuous, uninterrupted columnar pattern with minimal dispersion, with no center hole or gap at a linear speed greater than would be imparted by a fan alone. The inside surface of the housing 13 is a substantially smooth uninterrupted surface to minimize turbulence and energy loss.

Figure 8:
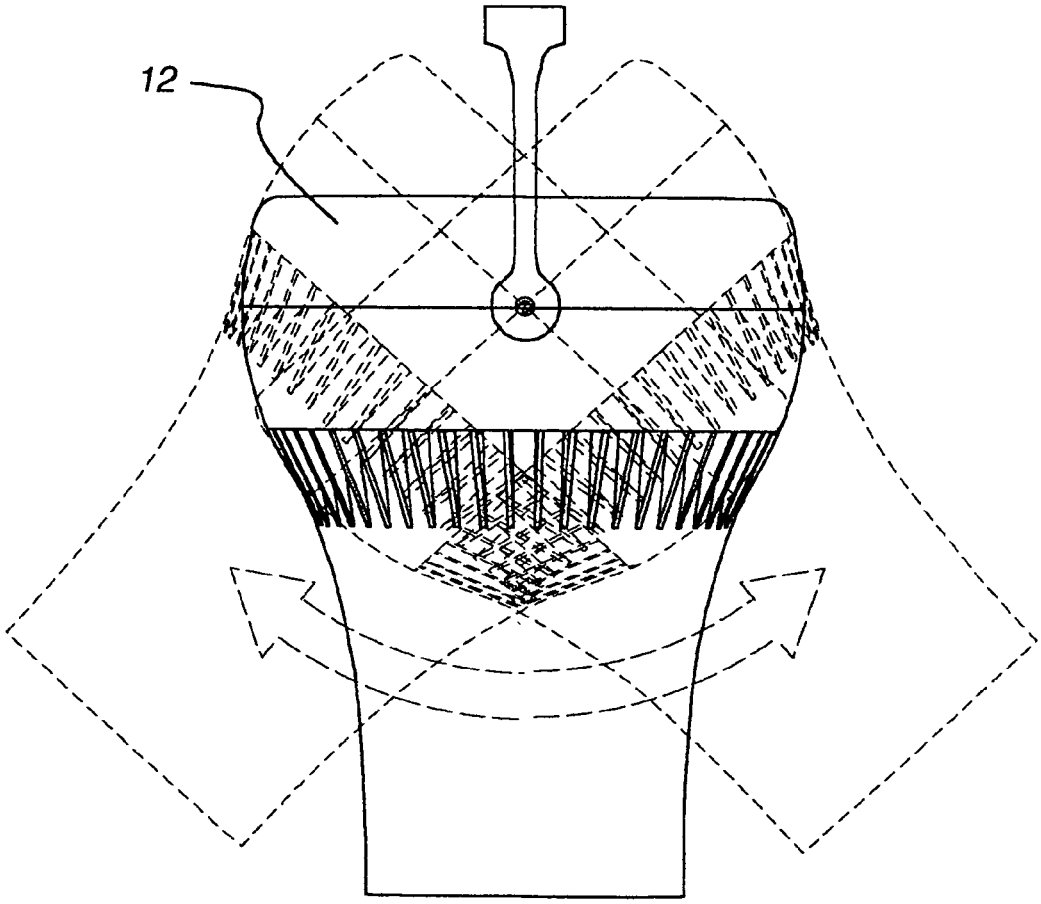
FIG. 8 is a side elevation view of the device of FIG. 1 showing angular direction of the device.
Figure 9:
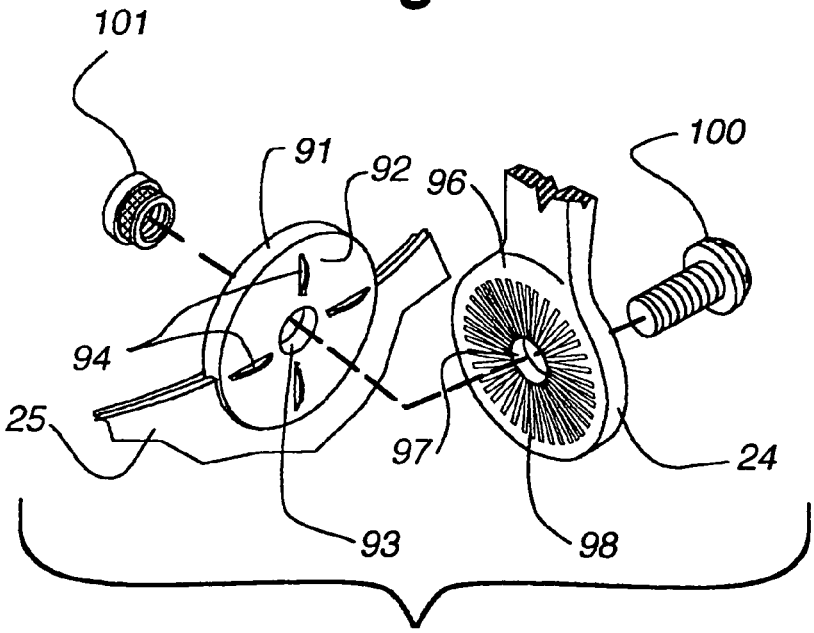
FIG. 9 is an enlarged, partial exploded view of the hangar attachment of the device of FIG. 1.

The hanger 23 is mounted to rotate and lock relative to the housing 13, so that when the hanger 23 is attached to an overhead support such as ceiling, the air flow from the air moving device 12 may be directed vertically or aimed at any selected angle from the vertical as shown in FIG. 8. As shown in FIGS. 1 and 9, the first section 25 of the housing 13 includes mounting tabs 91 on opposite sides on the upper edge of the first section 25. Each mounting tab 91 includes a round, outwardly directed mounting face 92, and a housing aperture 93 that extends inwardly through the center of the mounting tab 91. A pair of outwardly projecting housing ridges 94 extend radially on the mounting face 92 on opposite sides of the housing aperture 93.

Each end 24 of the hanger 23 has a round, inwardly facing hanger end face 96, similar in size to the mounting face 92 on the housing 13. A hanger end aperture 97 extends through the center of the hanger end face 96. A plurality of spaced, radially extending grooves 98, sized to receive the housing ridges 94, are provided on each hanger end face 96. Bolt 100 extends through the hanger end aperture 97 and threads into an internally threaded cylindrical insert 101, rigidly affixed in housing aperture 93. The angle of the housing 13 is chosen by selecting a pair of opposed grooves 97 on each hanger end 24 to receive the housing ridges 94. The pivotal arrangement enables the housing to move to a selected angle and is lockable at the selected angle to direct air flow at the selected angle.

Figure 10:
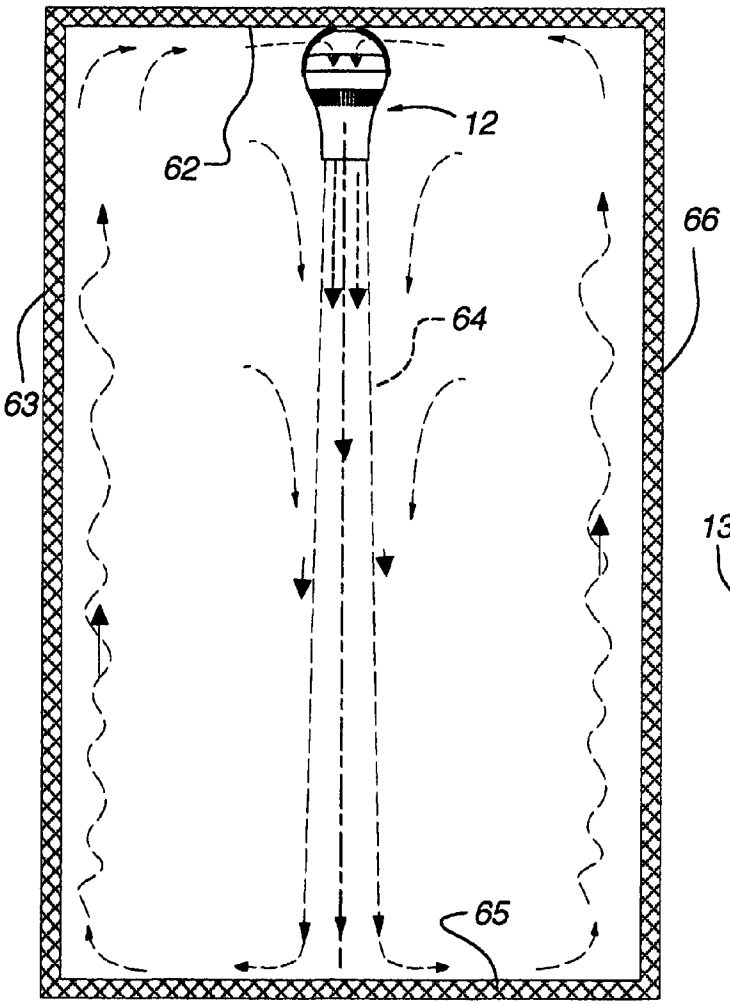
FIG. 10 is a side view of a room with the device of FIG. 1 showing an air flow pattern with dashed lines and arrows.

FIG. 10 shows an air moving device 12 mounted to the ceiling 62 of a room 63 shown as being closed sided with opposed side walls. Warm air near the ceiling 62 is pulled into the air moving device 12. The warm air exits the air moving device 12 in a column 64 that extends to the floor 65. When the column 64 reaches the floor 65, the warm air from the ceiling pushes the colder air at the floor 65 outward towards the opposed side walls 66 and upward towards the ceiling 62. When the column 64 reaches the floor 65, the warm air from the ceiling will also transfer heat into the floor 65, so that heat is stored in the floor 65. The stored heat is released when the ceiling is cooler than the floor. The heat may also be stored in articles on the floor and earth under the floor. The air moving device 12 destratifies the air in a room 63 without requiring the imperforate physical tube of many prior known devices. The air moving device 12 destratifies the air in a room 63 with the warmer air from the ceiling 62 minimally dispersing before reaching the floor 65, unlike many other prior known devices. The air moving device 12 will also remove dead air anywhere in the room. It is understood that the air moving device 12 may also be mounted horizontally in a container, trailer truck or room as is describe hereafter.

Figure 11:
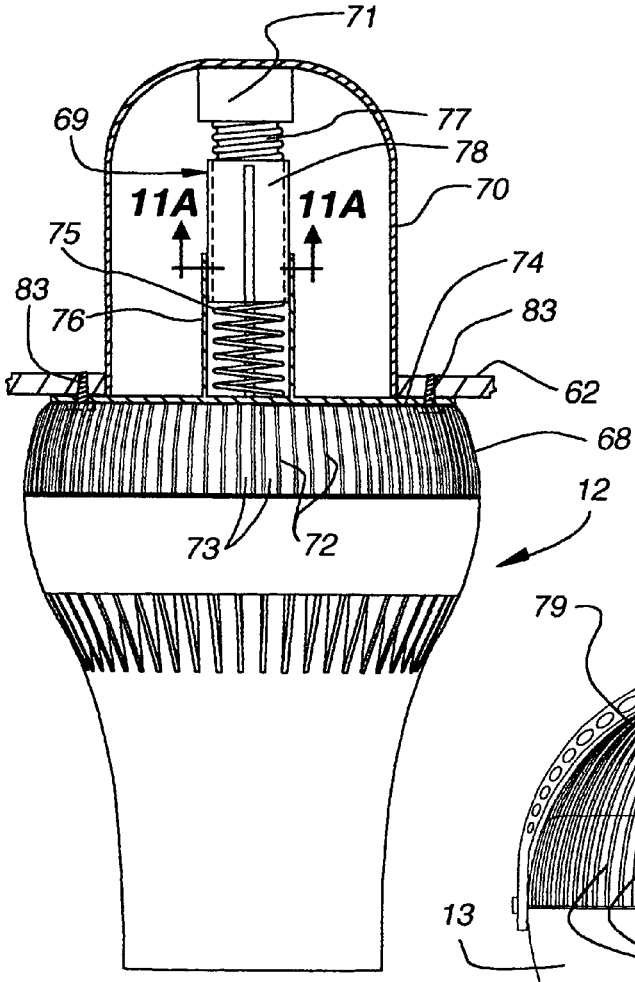
FIG. 11 is a side elevation view, partially cut away, showing the device of FIG. 1 modified for attachment to a light can.
Figure 11A:
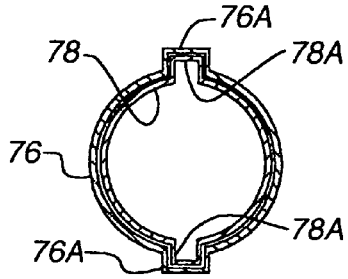
FIG. 11A is a sectional view taken along line 11A-11A of FIG. 11.

Referring to FIG. 11, an air moving device 12 is fitted with an inlet grill 68 and an electric connector 69 for attachment to a light can 70 with a light bulb socket 71 at the upper end. The inlet grill 68 includes a plurality of circumferentially spaced grill fins 72 that attach to the first end 17 of the housing 13. The grill fins 72 are separated by air intake slots 73, and extend axially outwardly from the first end 17 and curve radially inwardly and are integral with a flat circular mounting plate 74 that is substantially parallel with the first end 17. The electrical connector 69 has a tube 76 that is integral at one end with the center of the mounting plate 74 and extends axially therefrom, and a light bulb type, right hand thread externally threaded male end 77 attached to the other end of the shaft 78. Grill 68, plate 74 and tube 76 are shown as made of a one piece construction. Plate 74 has holes that received screws 83 or like fasteners to fasten plate 74 to ceiling 62.

The shaft 78 telescopes in the tube 76. The tube 76 has a pair of opposed keyways 76A that receive keys 78A on the shaft 78 which allow axial sliding movement of the shaft 78 in the tube 76. A compression spring 75 fits in the tube and bears against the bottom of shaft 78 and top of plate 74. Preferably the shaft 78 has a selected length relative to the length of the can 70 such that when the air moving device 12 is mounted in a can 70 in a ceiling 62, the threaded male end 77 engages the socket 71 before the mounting plate 74 contacts the ceiling 62 and when the threaded male end 77 is screwed into the socket 71, the mounting plate 74 bears against the ceiling 62. The spring 75 is compressed between plate 74 and shaft 78. Screws 83 fasten the plate to the ceiling 62. Since the light can 70 may be open to air above the ceiling 62, the mounting plate 74 is preferably sized to cover the open lower end of the can 70, so that only air from below the ceiling 62 is drawn into the air moving device 12. The air moving device 12 fitted with the inlet grill 68 and the electrical connector 69 can also be used with a ceiling light socket.

Figure 12:
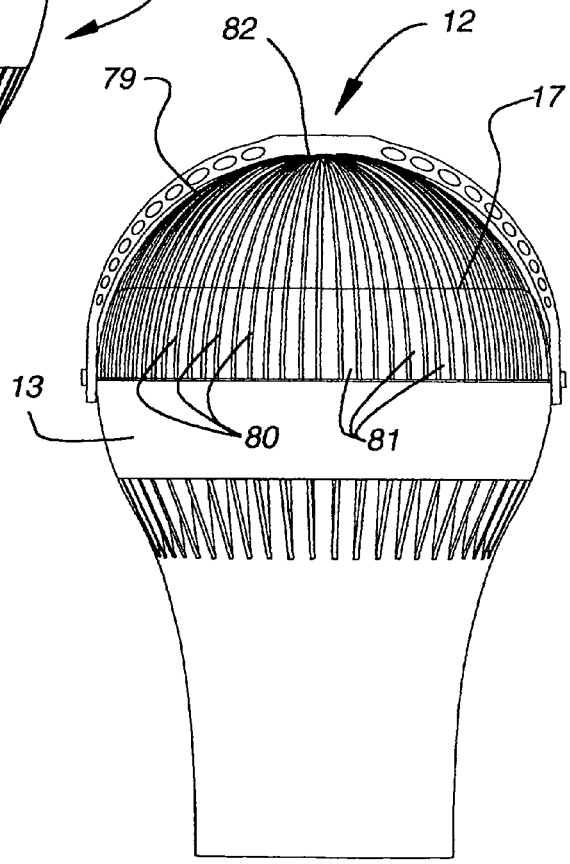
FIG. 12 is a side elevation view of the device of FIG. 1 with an intake grill.

The air moving device 12 may include an intake grill 79 for preventing objects from entering the impeller 31, as shown in FIG. 12. The intake grill 79 shown has a substantially hemispherical shape, and includes a plurality of circumferentially spaced grill fins 80 separated by intake slots 81. The grill fins 80 extend axially outwardly and curve radially inwardly from the first end 17 of the housing 13 to a central point 82 spaced from the first end 17. Other shapes of intake grills are suitable for the present invention.

Figure 13:
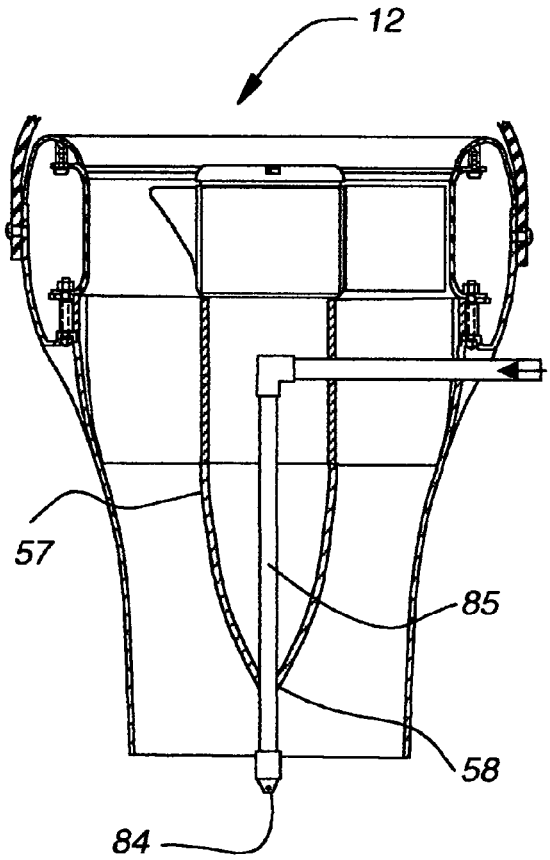
FIG. 13 is a sectional view taken along line 6-6 of FIG. 2 of the device of FIG. 1 with a misting nozzle.

FIG. 13 shows an air moving device 12 with a misting nozzle 84. The nozzle 84 extends through the point 58 of the housing hub 57 to spray water into the column of air exiting the air outlet 28 to cool the air through evaporation. The media exiting the nozzle 84 and being supplied through tube 85 can have other purposes such as a disinfectant or a fragrance or a blocking agent for distinctive needs. The nozzle 84 connects to a water line 85, in the housing hub 59 that connects to a water source (not shown).

Figure 14:
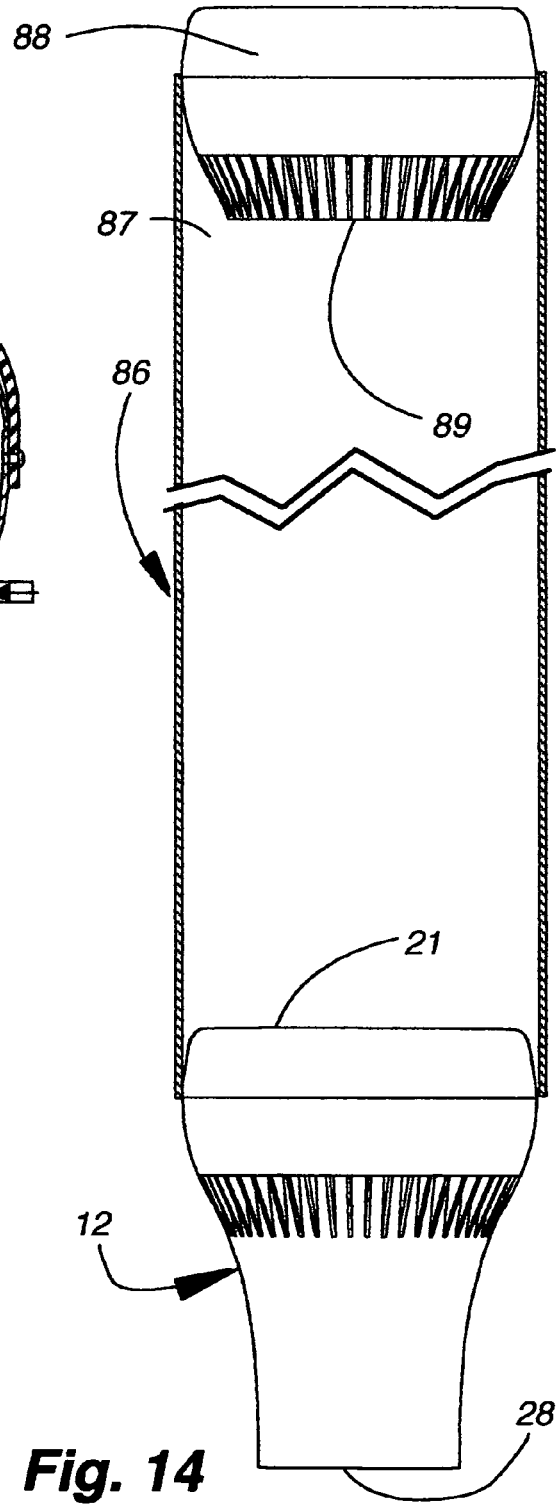
FIG. 14 is a side elevation view of the device of FIG. 1 in combination with a tube and second air moving device.
Figure 16:
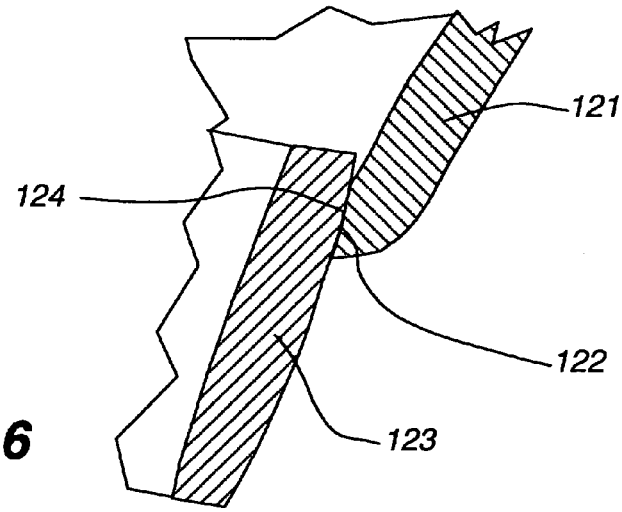
FIG. 16 is an enlarged view of a portion of FIG. 15.

FIG. 14 shows an air moving system 86 for use in buildings with very high ceilings, including an air moving device 12, an upwardly extending, tube 87 (shown cut away) connected at a lower end to the air inlet 21 of the air moving device 12, and a truncated upper air moving device 88 having an air outlet 89 connected to the upper end of the tube 87. The housing of device 88 is called truncated because it may be shortened or cut off below the fins 29. A conventional air moving device 12 may be used for device 88. The tube 87 may be flexible and is preferably fire resistant. The air moving system 86 is mounted to a ceiling or like support with the air outlet 28 of the air moving device 12 spaced above the floor, preferably about 10 to 50 feet. The tube may be for example from 30 to 100 feet long. The upper air moving device 88 at the top of the system 86 has a higher air moving flow capacity than the air moving device 12 at the bottom of the cascading system 86. By way of example, and not as a limitation, the upper air moving device 88 may have a capacity of 800 cfm and the air moving device 12 may have a capacity of 550 cfm.

FIGS. 15, 15A, 15B, 15C, 15D and 16 show the air moving device 12 mounted in an opening 103 in a ceiling 104. A generally cylindrical can 105 mounts on and extends above the ceiling 104, and has an open can bottom 106, and a closed can top 107. The can top 107 includes a semi-circular, downward opening, circumferentially extending channel 108. A semi-circular fin 111 extends radially across the channel 108 to prevent swirling of the air before entering the air inlet 21. Additional fins may be used. A grill and support assembly 125 mounts to the ceiling and extends and connects to the exterior of the housing of device 12. A grill including spaced openings 110 between fins 109 to allow air to flow up from the room along the housing and past the cowling 19 into the inlet 21. The grill and support assembly 125 includes an outer ring 120 fastened to the underside of the ceiling including the convexly curved grill fins 109 with air openings 110 between connected outer ring 120 and an inner ring 121. Ring 121 has a spherical concave inner bearing surface 122. A ring 123 has a spherical convexly curved exterior bearing surface 124 is mounted on and affixed to the housing with bearing surfaces 122 and 124 mating in a frictional fit to support the housing to be at a vertical position or tilted at an angle to the vertical axis and be held by friction at the vertical axis or a selected angle relative to the vertical axis to direct air flow as required.

The can 105 has an outwardly extending bottom flange 140 that fits against the underside of the ceiling 104. The can 105 preferably has four circumferentially spaced bottom openings 141 at 90 degree intervals that are rectangular in shape and extend up the can wall a short distance from the bottom flange 140. A clamping member 142 preferably made as a molded plastic body has a main body portion 143 above the ceiling 104 outside the can wall and an end flange portion 144 that fits inside the can opening 142. The main body portion 143 has a U-shaped outer wall portion 145 and an inner hub portion 146 having an aperture 147. The clamping member 142 inserts into the opening 141 via the open end of the can. A bolt fastener 151 extends through a hole in the flange, through a hole in the ceiling and threads into the aperture 147 in the main body portion to clamp the can 105 to the ceiling 104.

Figure 15:
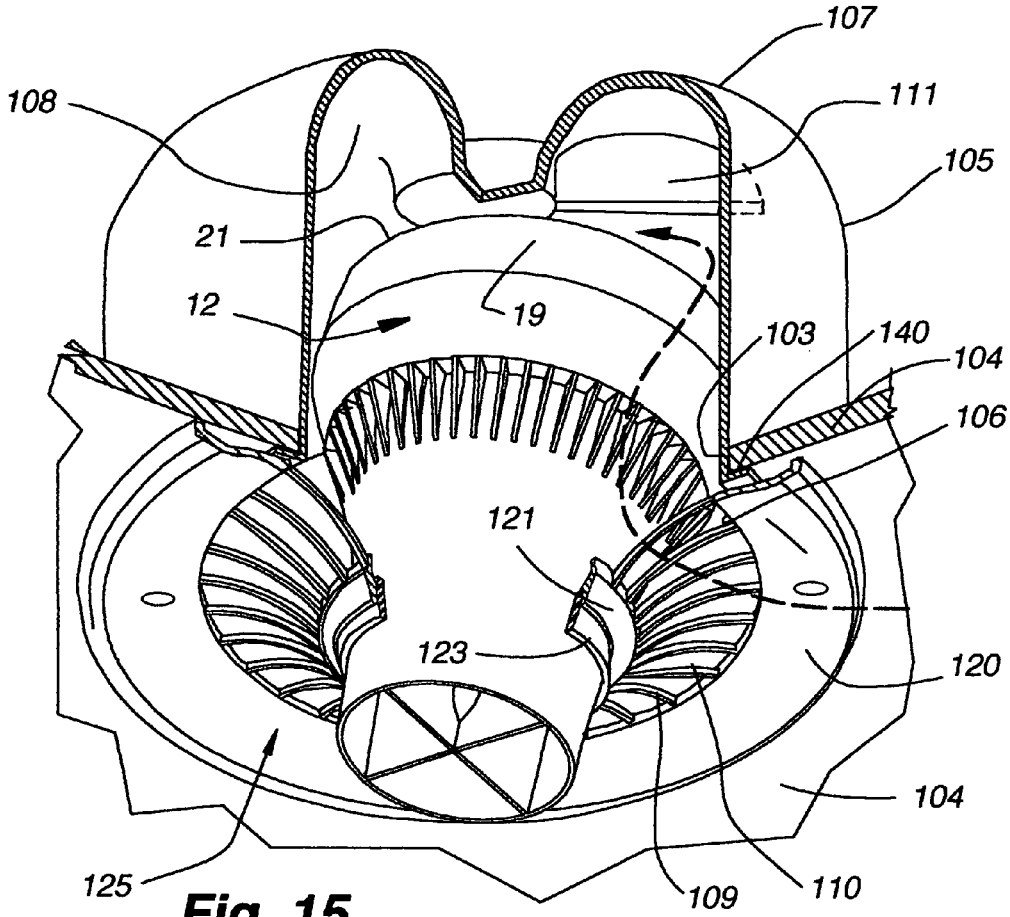
FIG. 15 is a bottom perspective view, partially cut away, showing the device of FIG. 1 mounted in a drop ceiling.
Figure 15A:
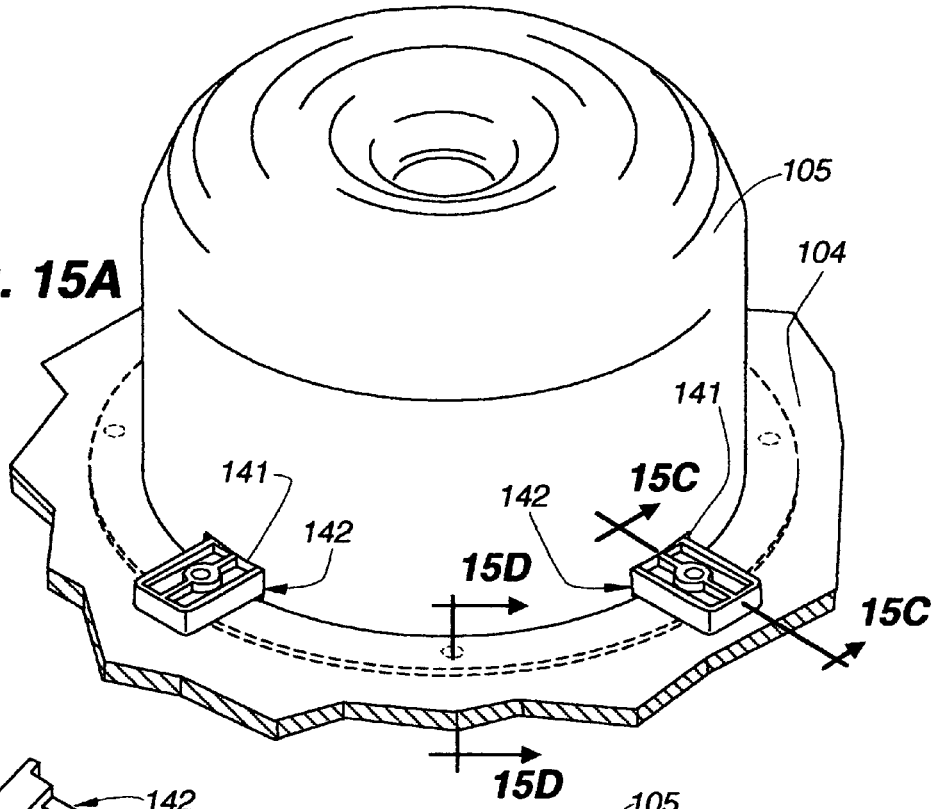
FIG. 15A is a top perspective view of FIG. 15.
Figure 15B:
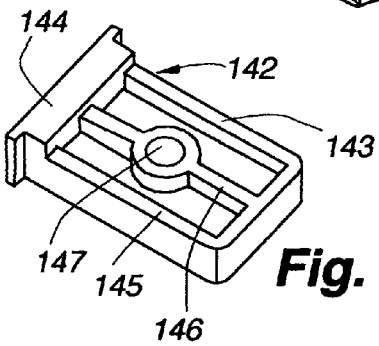
FIG. 15B is a top perspective view of the fastening member shown in FIG. 15A
Figure 15C:
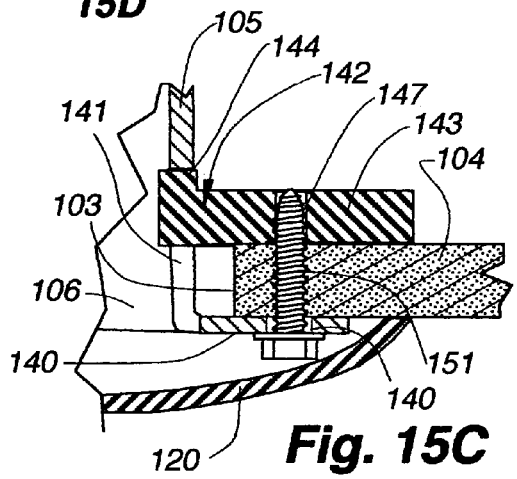
FIG. 15C is a sectional view taken along FIG. 15C-15C of FIG. 15A.
Figure 15D:
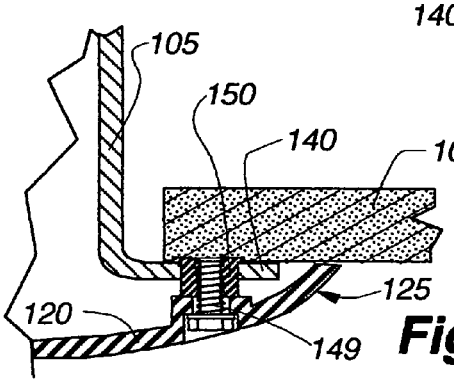
FIG. 15D is a sectional view along line 15D-15D of FIG. 15A.

As shown in FIG. 15D the grill and support assembly 125 is mounted to the ceiling 104 and can 105 by a bolt fastener 149 extending through an aperture in ring 120, through the ceiling 104 and into a nut 150 in flange 140 in the can. Preferably there are four bolt fasteners 149 at 90 degree intervals midway between fasteners 151 above described. The ceiling 104 typically would be a plasterboard ceiling in which a suitable hole is cut. A variation of FIG. 15 would be to extend or form the peripheral of outer ring 120 into a flat panel having a dimension of 2 ft. by 2 ft. that would fit in and be held by a grid that holds a conventional ceiling panel.

Figure 17:
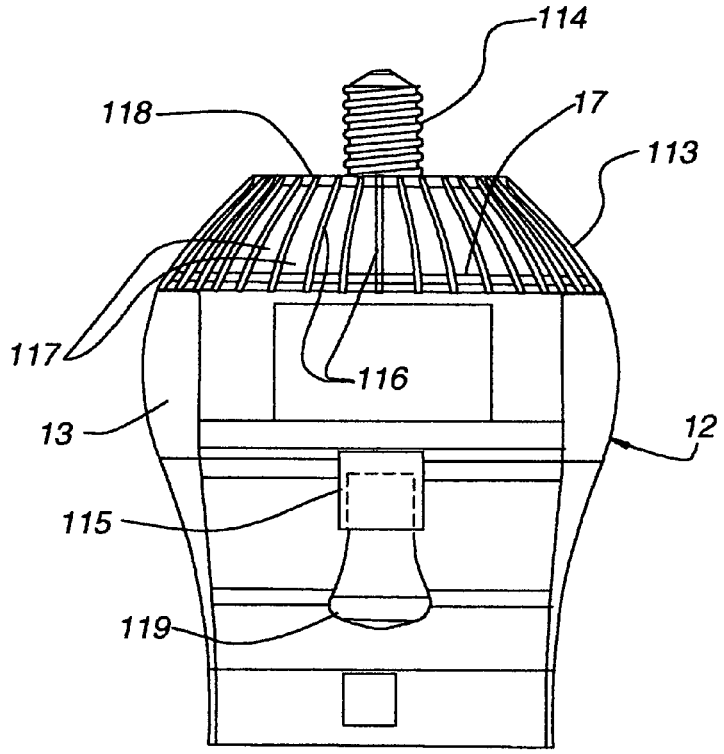
FIG. 17 is a side elevation view, partially cut away, showing the device of FIG. 1 modified for attachment to a light socket and having a light bulb at the lower end.

Referring to FIG. 17, an air moving device is fitted with an inlet grill 113, a light bulb style threaded male end 114 for threading into a light bulb socket, and a light bulb socket 115. The inlet grill 113 includes a plurality of circumferentially spaced grill fins 116 that attach to the first end of the housing 13. The grill fins 116 are separated by air intake slots 117, and extend axially outwardly from the first end 17 and curve radially inwardly to a flat circular mounting plate 118 that is substantially parallel with and spaced axially from the first end 17. Threaded male end 114 is mounted on and extends upwardly from the mounting plate 118. The socket 115 is mounted inside the housing 13 in a downwardly opening fashion so that light from a bulb 119 threaded into the socket 115 is directed downwards.

Figure 18:
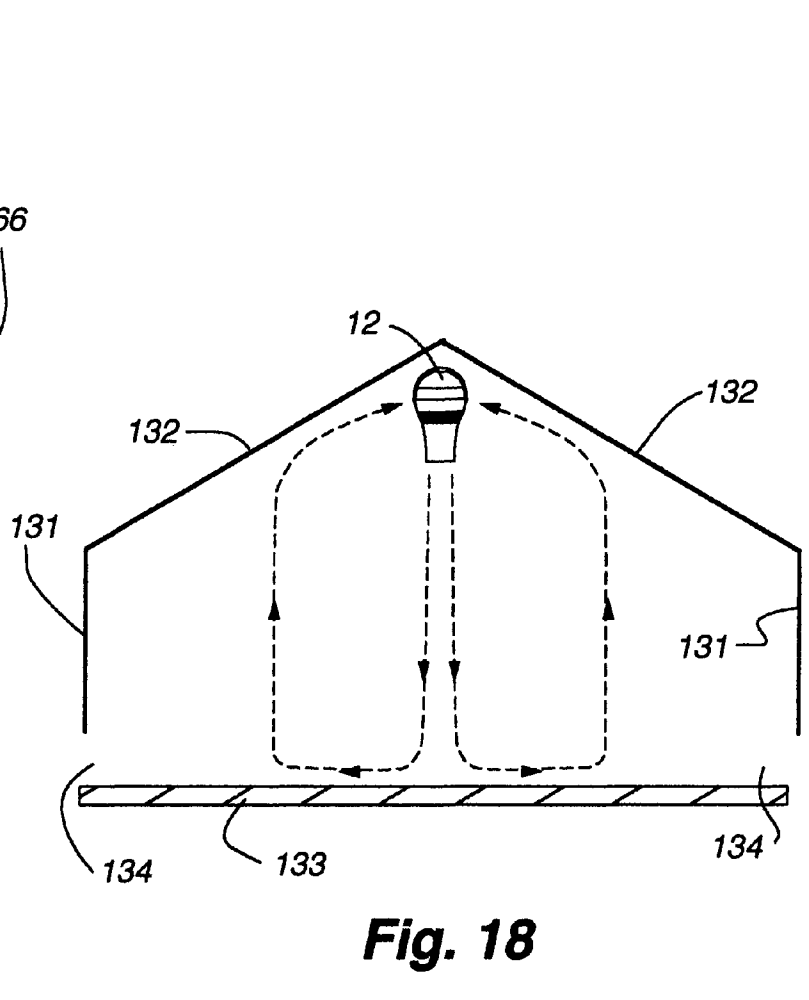
FIG. 18 is a schematic view of an open sided tent with an air moving device in the top.

Referring now to FIG. 18, there is shown a tent having an inclined top 132 extending down from an apex and connected at the lower end to a vertical side wall 131 and terminating above a floor 133 to provide a side opening 134 so that the tent is an open sided room. The air moving device 12 is mounted below the top apex and directs the air in the room downwardly in a columnar pattern to the floor and along the floor and then back with some air passing in and out the side openings 134 along the floor 133. For wide tents, the air will pass up before it reaches the side walls.

The air moving device and system herein described has relatively low electrical power requirement. A typical fan motor is 35 watts at 1600 rpm for an impeller of 8.5" that will effectively move the air from the ceiling to the floor in a room having a ceiling height of 30 ft. Another example is 75 watts with an impeller diameter 8.5" at 2300 rpm in a room having a ceiling height of 70 ft.

Figure 19:
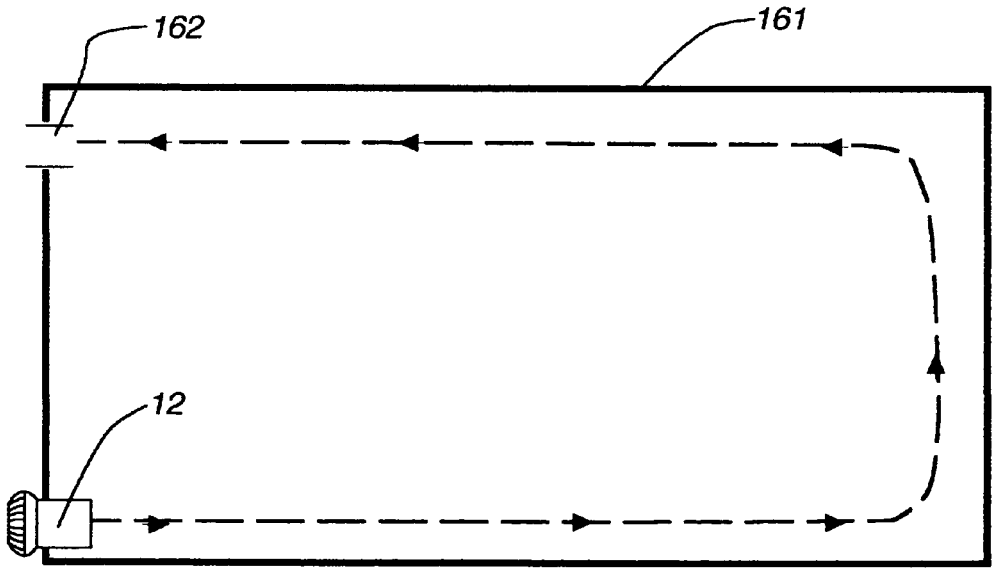
FIG. 19 is a schematic view of a shipping container with an air moving device at one lower end.

Referring now to FIG. 19, there is shown a shipping container 161 having an air moving device 12 disposed horizontally in the lower left end. The device 12 directs the air horizontally along the bottom wall or floor, up the opposite side wall and across the top wall to exit an outlet duct 162 above and spaced from the device 12 of the air moving device. The device 12 will penetrate the air and promote flushing and circulation of the air space. The device 12 may be mounted to direct the air generally horizontally or up or down at an angle to the true horizontal. This arrangement may be provided in other air spaces such as a trailer truck, room or the like.

It is understood that the stator 46 and housing 13 could be made as a single unit. It is also understood that the housing 13 may be made in two sections as for example a tubular section of a selected length may be added to the end of a truncated devices as shown in FIG. 14.

Although the present invention has been described with a certain degree of particularity, it is understood that the present disclosure has been made by way of example and that changes in details of structure may be made without departing from the spirit thereof.

What is claimed is:

1. An air moving device comprising:

a housing having an air inlet at a first end and an air outlet at a second end spaced from said first end with an air flow passage between said first and second ends, a rotary fan mounted in said housing near said air inlet and having an impeller with a diameter and a plurality of blades that produce an air flow with rotary and axial air flow components, said blades each having an upstream edge and a spaced downstream edge, and a plurality of spaced, radially extending air guide vanes that extend longitudinally in said housing between said impeller and said air outlet for converting said rotary component of said airflow into laminar and axial air flow in said housing, said vanes each having an upstream end, said vanes being spaced from said impeller by a gap between said upstream ends of said vanes and said downstream edges of said blades, said gap having a selected size, said gap size being selected to be less than one half of said diameter of said impeller to avoid generation of turbulence and reduce static back pressure in said air flow, whereby said air flow exits said air outlet in an axial stream extending beyond said air outlet in a columnar pattern with minimal lateral dispersion.

2. The device as set forth in claim 1 wherein said gap is selected to be no less than a selected minimum dimension to avoid noise.

3. The device as set forth in claim 1 wherein said air flow passage has a cross sectional area that decreases from said air inlet to said air outlet to increase air flow velocity.

4. The device as set forth in claim 3 wherein said cross sectional area decreases by about 10% to 35%.

5. The device as set forth in claim 1 wherein each of said blades incline at a selected angle to an axis of rotation for said impeller, each said blade extending axially and radially outwardly toward said second end to produce said air flow in said housing, each said vane having a curved vane portion inclined at an angle opposite said incline of each blade that extends axially and radially inwardly toward said second end to assist in converting said rotary component of said air flow into said laminar and axial air flow.

6. The device as set forth in claim 1 wherein said vanes are straight.

7. The device as set forth in claim 1 including a stator in and separable from said housing, and wherein said vanes include an upstream portion in said stator and a downstream portion affixed to the inside of said housing downstream of said stator, said downstream portion operating in conjunction with said upstream portion to direct said air flow through said housing.

8. The device as set forth in claim 1 including a cowling having an outer end surface with a smooth radius at said first end that directs air flow at said air inlet to flow into said housing along a curve to minimize turbulence and noise.

9. The device as set forth in claim 1 wherein said housing has an inner surface that is substantially smooth and uninterrupted to minimize turbulence and energy loss, and an inner housing hub in said housing having a downstream housing hub portion inward of said vanes and spaced from said inner surface to reduce turbulence in said air flow along said vanes, said downstream housing hub being torpedo shaped converging toward said second end to direct air flow to avoid turbulence.

10. The device as set forth in claim 1 including a hanger pivotally connected to said housing to mount said housing in a dependent manner from a support, said hanger enabling said housing to move to selected angles, said hanger being lockable at said selected angle to direct air flow at said selected angle.

11. An air moving device comprising:

a housing having an air inlet at a first end and an air outlet at a second end spaced from said first end with an air flow passage between said first and second ends, a rotary fan mounted in said housing near said air inlet and having an impeller with a plurality of blades that produce an air flow with rotary and axial air flow components, said blades each having an upstream edge and a spaced downstream edge, a plurality of spaced, radially extending air guide vanes that extend longitudinally in said housing between said impeller and said air outlet for converting said rotary component of said airflow into laminar and axial air flow in said housing, said vanes each having an upstream end, said vanes being spaced from said impeller by a gap between said upstream ends of said vanes and said downstream edges of said blades, said gap having a selected size, said gap size being selected to be no greater than a selected maximum dimension to avoid generation of turbulence and reduce static back pressure in said air flow, whereby said air flow exits said air outlet in an axial stream extending beyond said air outlet in a columnar pattern with minimal lateral dispersion, and means to fasten said housing to a can light recessed in a ceiling to suspend said housing from said can light, said means to fasten including an electric connector having an externally threaded male end for connecting to a light bulb socket in said light can, a mounting plate at said first end of said housing, a tube attached to the top of the mounting plate, said means to fasten including a compression spring in said tube, a shaft telescoping in said tube and axially slidable therein, and co-operating interfitting key and slot portions on said tube and shaft to prevent relative rotation between said tube and shaft, said male end being carried on the end of said shaft opposite said spring, said spring urging said male end into said socket.

12. An air moving device comprising:

a housing having an air inlet at a first end and an air outlet at a second end spaced from said first end with an air flow passage between said first and second ends, a rotary fan mounted in said housing near said air inlet and having an impeller with a plurality of blades that produce an air flow with rotary and axial air flow components, said blades each having an upstream edge and a spaced downstream edge, a plurality of spaced, radially extending air guide vanes that extend longitudinally in said housing between said impeller and said air outlet for converting said rotary component of said airflow into laminar and axial air flow in said housing, said vanes each having an upstream end, said vanes being spaced from said impeller by a gap between said upstream ends of said vanes and said downstream edges of said blades, said gap having a selected size, said gap size being selected to be no greater than a selected maximum dimension to avoid generation of turbulence and reduce static back pressure in said air flow, whereby said air flow exits said air outlet in an axial stream extending beyond said air outlet in a columnar pattern with minimal lateral dispersion, and an electric connector having an externally threaded male end mounted to said first end of said housing for connecting to a light bulb socket, a grill on said housing for permitting air to enter said inlet, and an electric light bulb socket mounted inside said housing to illuminate a room in which said housing is mounted.

13. An air moving device comprising:

a housing having an air inlet at a first end and an air outlet at a second end spaced from said first end with an air flow passage between said first and second ends, a rotary fan mounted in said housing near said air inlet and having an impeller with a plurality of blades that produce an air flow with rotary and axial air flow components, said blades each having an upstream edge and a spaced downstream edge, a plurality of spaced, radially extending air guide vanes that extend longitudinally in said housing between said impeller and said air outlet for converting said rotary component of said airflow into laminar and axial air flow in said housing, said vanes each having an upstream end, said vanes being spaced from said impeller by a gap between said upstream ends of said vanes and said downstream edges of said blades, said gap having a selected size, said gap size being selected to be no greater than a selected maximum dimension to avoid generation of turbulence and reduce static back pressure in said air flow, whereby said air flow exits said air outlet in an axial stream extending beyond said air outlet in a columnar pattern with minimal lateral dispersion, and a grill and support assembly for mounting to a ceiling, said grill and support assembly having an inner ring with a spherical concave inner bearing surface, and a housing ring sized and shaped to receive said housing, said second ring having a spherical convexly curved exterior second bearing surface sized and shaped to mate in a frictional fit with said inner bearing surface to support said housing from said ceiling and enable said housing to be vertical and to tilt at selected angles to the vertical and be frictionally held at a selected position.

14. The device as set forth in claim 13 wherein said grill and support assembly includes an outer ring for fastening to a ceiling and a plurality of spaced, radial, downwardly concave grill fins extending between said inner ring and said outer ring.

15. The device as set forth in claim 14 including a generally cylindrical can having a closed top, an open bottom and a bottom flange extending outwardly from said bottom, said can being sized to fit into an opening in a ceiling with said bottom flange mounting to said ceiling, said can being sized to fit around said housing above said housing ring, said can including at least one fin attached to said top to prevent rotational flow of the air before entering said inlet.

16. The device as set forth in claim 15:

including a clamping member and a fastener, said clamping member having a main body portion and a flange portion at one end of said main body portion, wherein said can includes an opening spaced from said bottom and sized to receive said flange portion, said fastener extending through said bottom flange and said ceiling, and connecting to said main body portion to clamp said can to said ceiling.

17. The device as set forth in claim 16 including a plurality of said clamping members and wherein said can includes openings for said clamp members at circumferentially spaced positions.

18. The device as set forth in claim 1 including a water line in said housing with a nozzle at one end to form a mist in the air discharging from said second end to reduce air temperature.

19. The device as set forth in claim 1 wherein the number of said blades is different from the number of said vanes to minimize noise.

20. The device as set forth in claim 1 wherein there are three said blades and four said vanes.

21. An air moving device comprising:

a housing having an air inlet at a first end and an air outlet at a second end spaced from said first end with an air flow passage between said first and second ends, a rotary fan mounted in said housing near said air inlet and having an impeller with a diameter including a hub with an axis of rotation and a plurality of circumferentially spaced, radially extending blades mounted on said hub, said blades producing an air flow with rotary and axial air flow components, said blades each having an upstream edge and a spaced downstream edge, and a plurality of spaced air guide vanes that extend axially and radially relative to said axis in said housing between said impeller and said air outlet for converting said rotary component of said air flow into laminar axial air flow in said housing, said vanes each having an upstream end, said vanes being spaced in close proximity to said impeller by a gap between said upstream ends of said vanes and said downstream edges of said blades, said gap having a selected size, said gap size being selected to be less than one half of said diameter of said impeller to avoid generation of turbulence and reduce static back pressure in said air flow, whereby said air flow exits said air outlet in an axial stream extending beyond said air outlet in a columnar pattern with minimal lateral dispersion.

22. The device as set forth in claim 1 including a can having a closed top, and an open bottom, said can being sized to fit into an opening in a ceiling with said bottom mounting to said ceiling, said can being sized to receive and fit around said housing, said can including at least one fin attached to said top to prevent rotational flow of the air before entering said inlet.

* * * * *